United States Patent [19]

Berman

[11] Patent Number: 4,577,562

[45] **Date of Patent: * Mar. 25, 1986**

[54] TELLER MACHINE ENCLOSURE

[76] Inventor: James Berman, 160 E. 93rd St., New York, N.Y. 10028

[ * ] Notice: The portion of the term of this patent subsequent to Apr. 30, 2002 has been disclaimed.

[21] Appl. No.: 601,649

[22] Filed: Apr. 18, 1984

[51] Int. Cl.[4] ..... G07G 5/00; E06B 7/32

[52] U.S. Cl. ..... 109/24.1; 109/66; 52/67

[58] Field of Search ..... 109/2, 24, 24.1, 49.5, 109/50, 58, 45, 47, 48, 49, 64, 66, 73, 81; 52/67, 69

[56] References Cited

U.S. PATENT DOCUMENTS

| | | | |
|---|---|---|---|
| Re. 22,431 | 2/1944 | Sloan, Jr. et al. | 52/67 |
| 1,740,888 | 12/1929 | Davidson | 109/73 |
| 3,897,901 | 8/1975 | Grosswiller, Jr. | 109/24.1 |
| 4,192,544 | 3/1980 | Patterson | 52/67 |
| 4,497,261 | 2/1985 | Forris et al. | 109/66 |
| 4,513,670 | 4/1985 | Berman | 109/24.1 |

*Primary Examiner*—Kenneth J. Dorner
*Assistant Examiner*—Neill Wilson
*Attorney, Agent, or Firm*—McAulay, Fields, Fisher, Goldstein & Nissen

[57] ABSTRACT

An automatic teller machine (ATM) with an operable front panel and an openable service panel is securely enclosed in an enclosure. The enclosure includes a first side wall extending at least from a floor at a first side of the ATM up, over and down to the floor on the second side of the ATM. A front wall with a cut-out zone therein, is provided which moves between an inward position and an outward position. In its position the front wall is secured to the first side wall. In its outward position the front wall is spaced from the first side wall. The cut-out zone has a perimeter sized and shaped to permit access to the operable front panel of the ATM when the front wall is in its inward position. Together the first side wall and the front wall define a first enclosure. A second side wall is connected to and extends inwardly from the front wall. When the front wall is in its outward position the second side wall extends between the first side wall and the front wall to provide a second enclosure space outward of and in communication with first enclosure space. A flexible shield, movable between a retracted and protracted position, is provided. The shield in its protracted position covers the cut-out zone and in its retracted position permits the cut-out zone to encompass the teller machine front panel.

7 Claims, 6 Drawing Figures

TELLER MACHINE ENCLOSURE

BACKGROUND OF THE INVENTION

This invention relates in general to a securely enclosed automatic teller machine, which is commonly referred to as an ATM in the art. More particularly this invention relates to an automatic teller machine securely enclosed in a telescoping enclosure.

It is known that in banking facilities, considerations of both space and security have limited the usefulness of automatic teller machines. When these automatic teller machines are installed in banks, it is necessary to provide secure access to the service panel of the machine so that repair work can be done and so that cash can be replaced. The secure access must be provided using a minimum of floor space. When these automatic teller machines are installed in locations outside of banks, the problem of providing secure access to the service panel and the problem of minimizing the total space taken up becomes more acute than in a bank building.

One way of providing secure access to an automatic teller machine using a minimum amount of floor space is disclosed in my pending application Ser. No. 313,209, now U.S. Pat. No. 4,513,670, filed on Oct. 20, 1981. My '209 application discloses a secure telescoping enclosure for an automatic teller machine which includes a rear enclosure wall that moves from a retracted position backwardly to a protracted position to thereby define first and second enclosures. Although the enclosure of the '209 application uses only a small amount of floor space it does necessitate the use of floor space behind the rear wall so that it can be moved to its protracted position.

Although disclosing a free standing teller machine enclosure for use in drive-up bank facilities, my pending application Ser. No. 556,966 filed on Dec. 1, 1983 is generally relevant to this art.

When automatic teller machines are installed in existing buildings, it is often advantageous to provide access to the rear service panel of the teller machine from in front of the front wall of the enclosure. This is particularly true when little or no space can be used behind the enclosure as is usually the case where the ATM is built into an existing wall. However, a problem exists because the space in front of the enclosure is normally non-secured space which is visable and accessible to the public.

Accordingly, it is a purpose of the present invention to provide a securely enclosed automatic teller machine which requires the allocation of very little floor space behind the enclosure.

It is another purpose of this invention to provide a secure enclosure for a teller machine which permits access to the rear service panel of the machine from an area forward of the front panel of the machine.

Another purpose of this invention is to provide such an enclosure which enables the non-secured area in front of the enclosure to be quickly and easily secured.

BRIEF DESCRIPTION

In brief, one embodiment of this invention involves a telescoping enclosure which securely encloses an automatic teller machine. The automatic teller machine is of the type having an operable front panel and an openable access panel. The telescoping enclosure includes a first side wall which extends from a floor at a first side of the teller machine, up, over and down to the floor on a second side of the teller machine. It further includes a front wall. The front wall can move between an inward position in which it is secured to the first side wall and an outward position in which it is disconnected and spaced from the first side wall. The front wall of the enclosure is formed with a cut-out zone therein. The perimeter of the cut-out zone is sized and shaped to contact the rim of the operable front panel of the automatic teller machine when the front wall is in its inward position so that only the front panel of the teller machine is exposed therethrough.

Together the first side wall and the front wall, in its inward position, define a first enclosure space. When the front wall is in the inward position, users have access to the operable front panel of the teller machine but the rear access panel is inaccessible to the servicers.

The enclosure also includes a second side wall connected to the front wall. The second side wall extends in from the front wall. When the front wall is in its outward position the second side wall extends over the space between the first side wall and the front wall to provide a second enclosure space adjacent to and in communication with the first enclosure space. When the front wall is in its outward position the operable front panel of the teller machine is not accessible to a user. However, when the front wall is in its outward position a servicer can enter into the second enclosure space using a lockable door provided therein and gain access to the openable service panel.

A flexible movable shield is provided which moves between a retracted and protracted position. When the front wall is in its outward position, the shield is in its protracted position to cover the cut-out zone and secure the enclosure space. When the front wall is in its inward position, the shield is in its retracted position to permit the cut-out zone to encompass the operable front panel.

BRIEF DESCRIPTION OF THE DRAWINGS

In FIG. 1, as in all the FIGS., the ATM is shown in outline to simplify and clarify the presentation. FIG. 1 is taken along the plane 1—1 as shown in FIG. 3.

FIG. 2 is taken along the offset horizontal plane 2—2 of FIG. 4.

FIG. 3 shows the automatic teller machine supported on the rotatable base.

DESCRIPTION OF THE PREFERRED EMBODIMENT

As shown in the FIGS. all of which represent the same embodiment, the enclosure 10 is formed to securely enclose an automatic teller machine 12. Automatic teller machine 12 has a front operating panel 14 and an openable service panel 16. In the automatic teller machine 12 shown, the openable service panel 16 is located at the rear of the teller machine.

Figure 1:
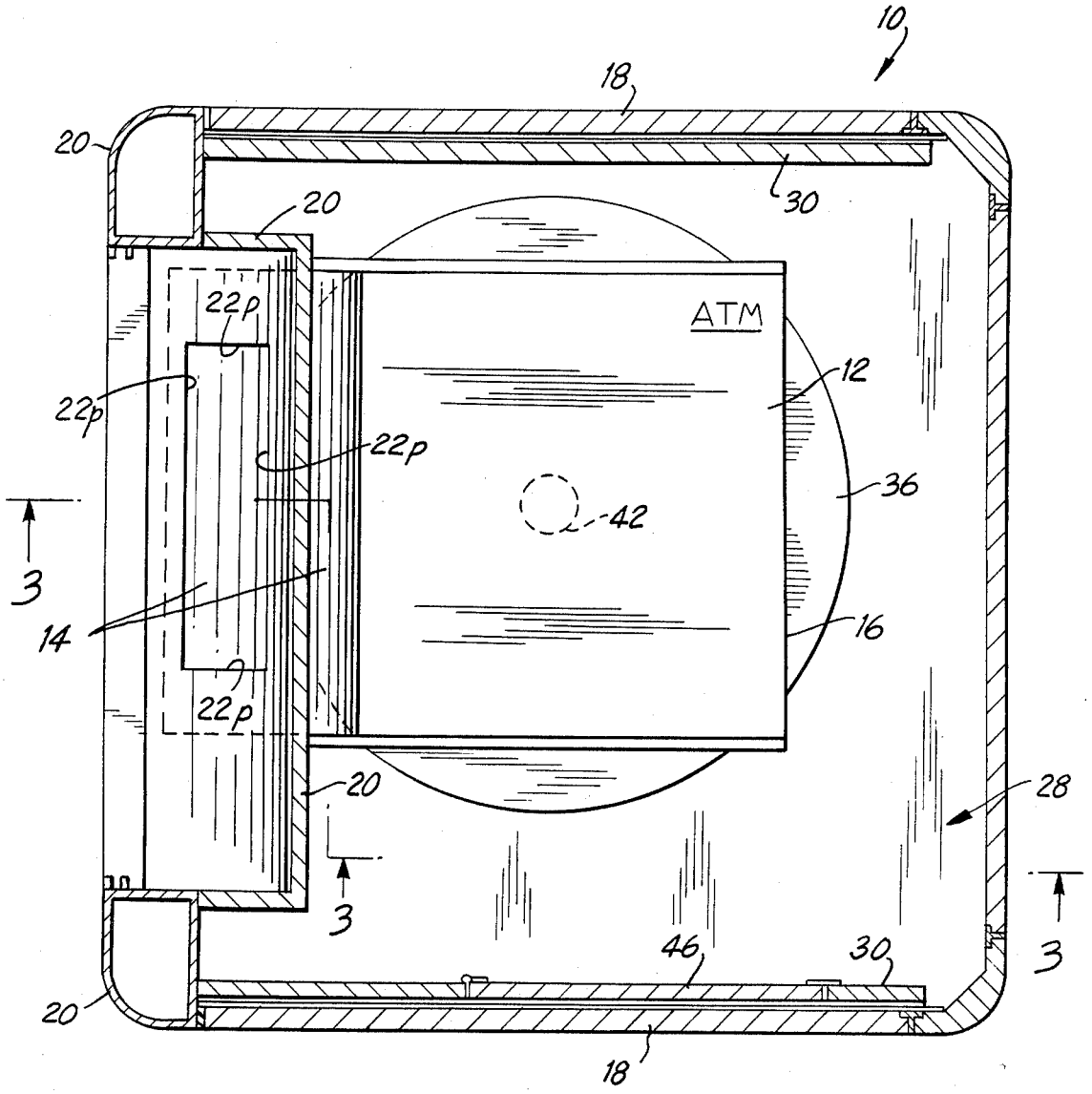
FIG. 1 is a sectional view along a horizontal plane of the enclosure of the present invention with the front wall in its inward position.
Figure 2:
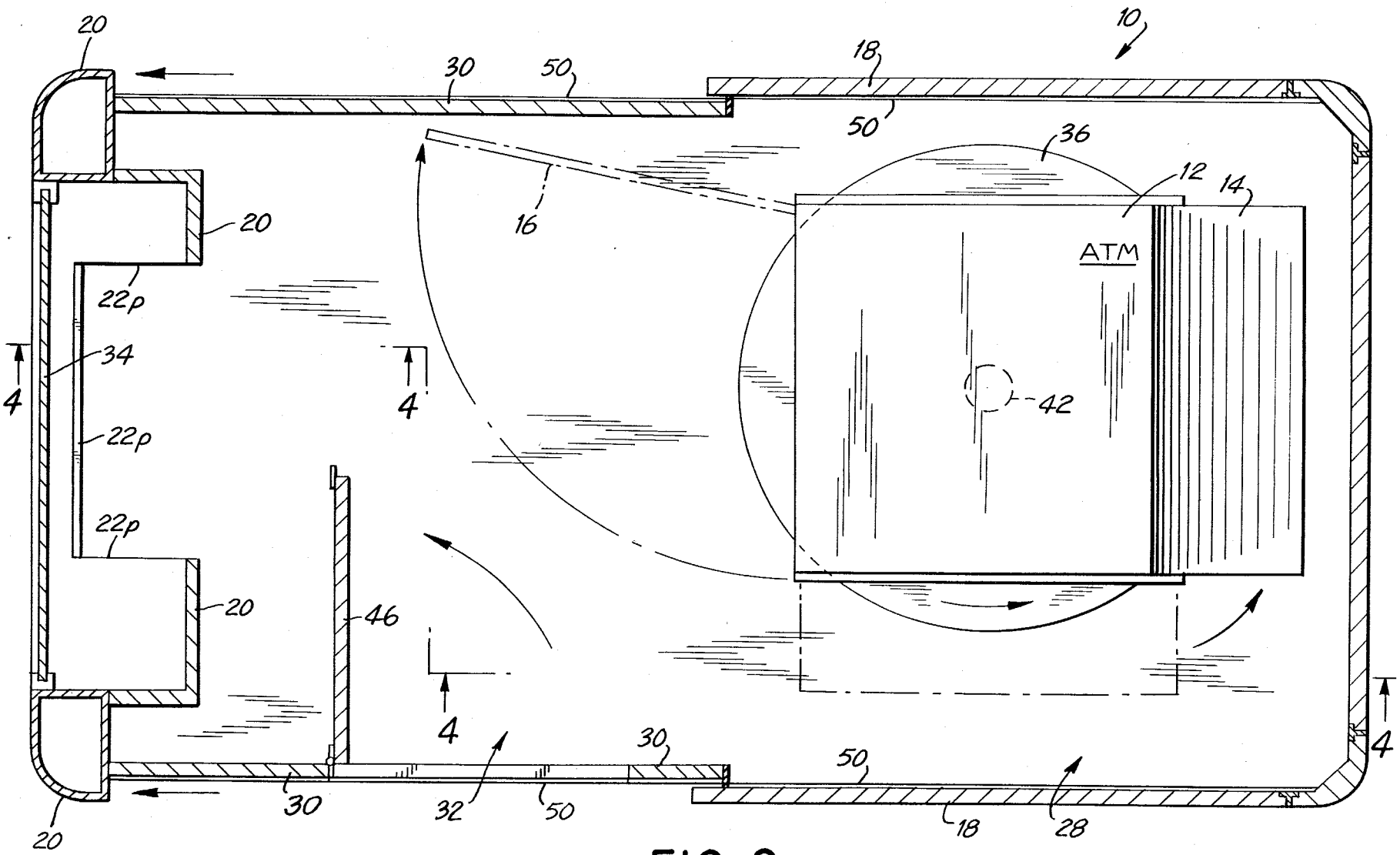
FIG. 2 is a view analogous to FIG. 1 showing the enclosure when the front wall is in its outward and extended position.
Figure 3:
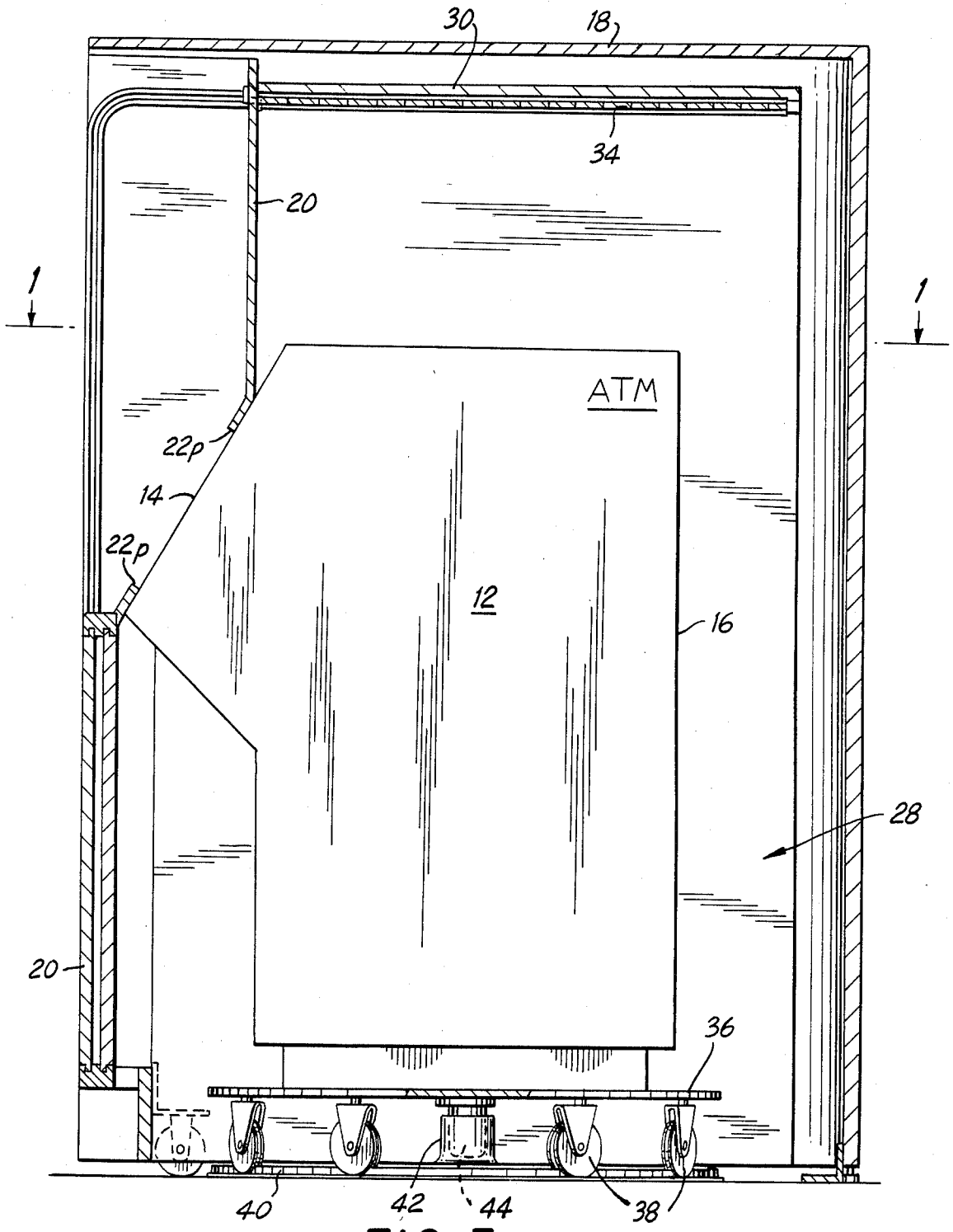
FIG. 3 is a sectional view taken along the offset vertical plane 3—3 of FIG. 1.
Figure 4:
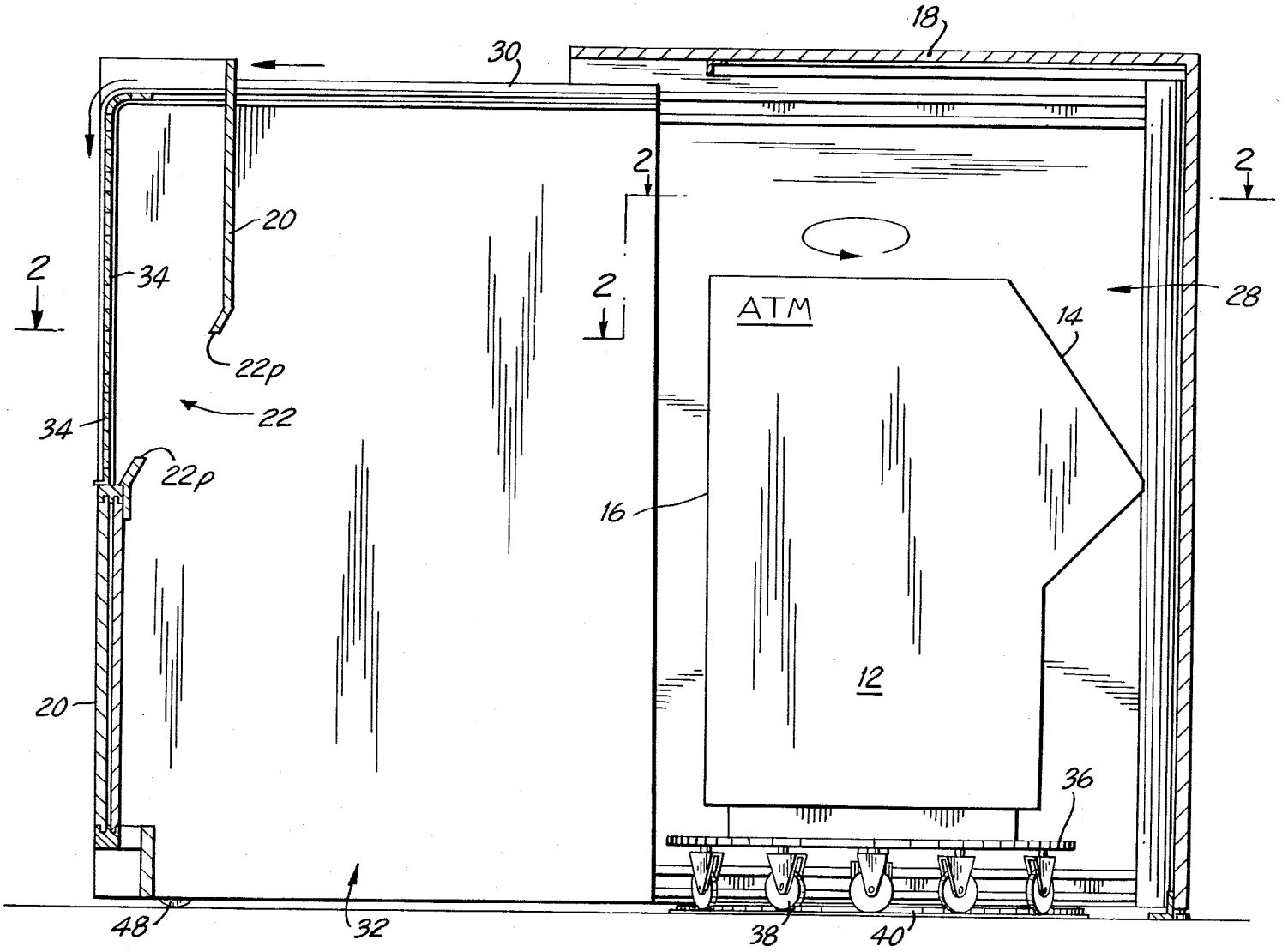
FIG. 4 is a sectional view taken along the offset vertical plane 4—4 of FIG. 2.

Enclosure 10 has a first side wall 18 which has a fixed position. This side wall 18 extends from the floor at one side of the teller machine 12, up, over and down to the floor on the other side of teller machine 12. A front enclosure wall 20 is provided. Front enclosure wall 20 is formed with a cut-out zone 22 therein. Front wall 20 can move between an inward position, as shown in FIGS. 1 and 3, in which it is secured to the first side wall 18 and an outward position, as shown in FIGS. 2 and 4, in which it is disconnected from first side wall 18. When front wall 20 is in the outward position it is spaced from first side wall 18.

The perimeter 22*p* of cut-out zone 22 is sized and shaped to encompass the front operating panel 14 when the front wall 20 is in its inward position. Thus when front wall 20 is in its inward position only the front operating panel 14 of the machine is exposed.

First side wall 18 and front wall 20, when wall 20 is in its inward position, define a first enclosure space 28.

A second side wall 30 is connected to the front wall 20 and extends inward from the front wall 20. Second side wall 30 extends from the floor at one side of the ATM 12, up, over and down to the floor at the other side of the ATM 12. Thus the second side wall 30 and front wall 20 are movable as a unit between an inward position and an outward position.

When front wall 20 is in its outward position second side wall 30 extends between the first side wall 18 and the front wall 20 to provide a second enclosure space 32 which is positioned outward of and in communication with first enclosure space 28.

Figure 6:
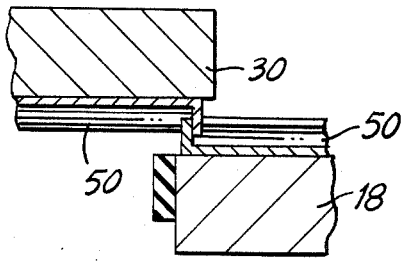
FIG. 6 is a sectional view taken substantially along line 6—6 of FIG. 5.

A flexible movable tambour 34 is provided. Tambour 34 is movable between a retracted position, as best shown in FIG. 3, and a protracted position as best shown in FIGS. 4 and 6. Tambour 34, when in its protracted position, covers cut-out zone 22 to secure the enclosure space 28, 32 when front wall 20 is in its outward position. When front wall 20 is in its inward position, tambour 34 is in its retracted position to uncover cut-out zone 22 and permit cut-out zone 22 to encompass front operating panel 14.

Automatic teller machine (ATM) 12 is mounted on a base 36. Grooved wheels 38 are attached to the bottom of base 36. A pipe track 40 is provided on which wheels 38 ride. The grooved wheel and pipe arrangement provides ease of movement by preventing fouling by dust and dirt which generate resistance to rotation. Base 36 with wheels 38 rotates at least 180° so that the service panel 16 of the ATM can be reached by service personnel in space 32. A central sleeve 42 and a post 44 prevent base 36 from moving laterally and thus assure that the wheel 38 will not jump off the pipe track 40.

A lockable door 46 is in second side wall 30. Door 46 permits access to the interior of enclosure 10. Access to the door 46 is blocked by fixed side wall 18 when the front wall 20 is in its inward position. Thus the door 46 is inaccessible unless the front wall is in its outward position.

Figure 5:
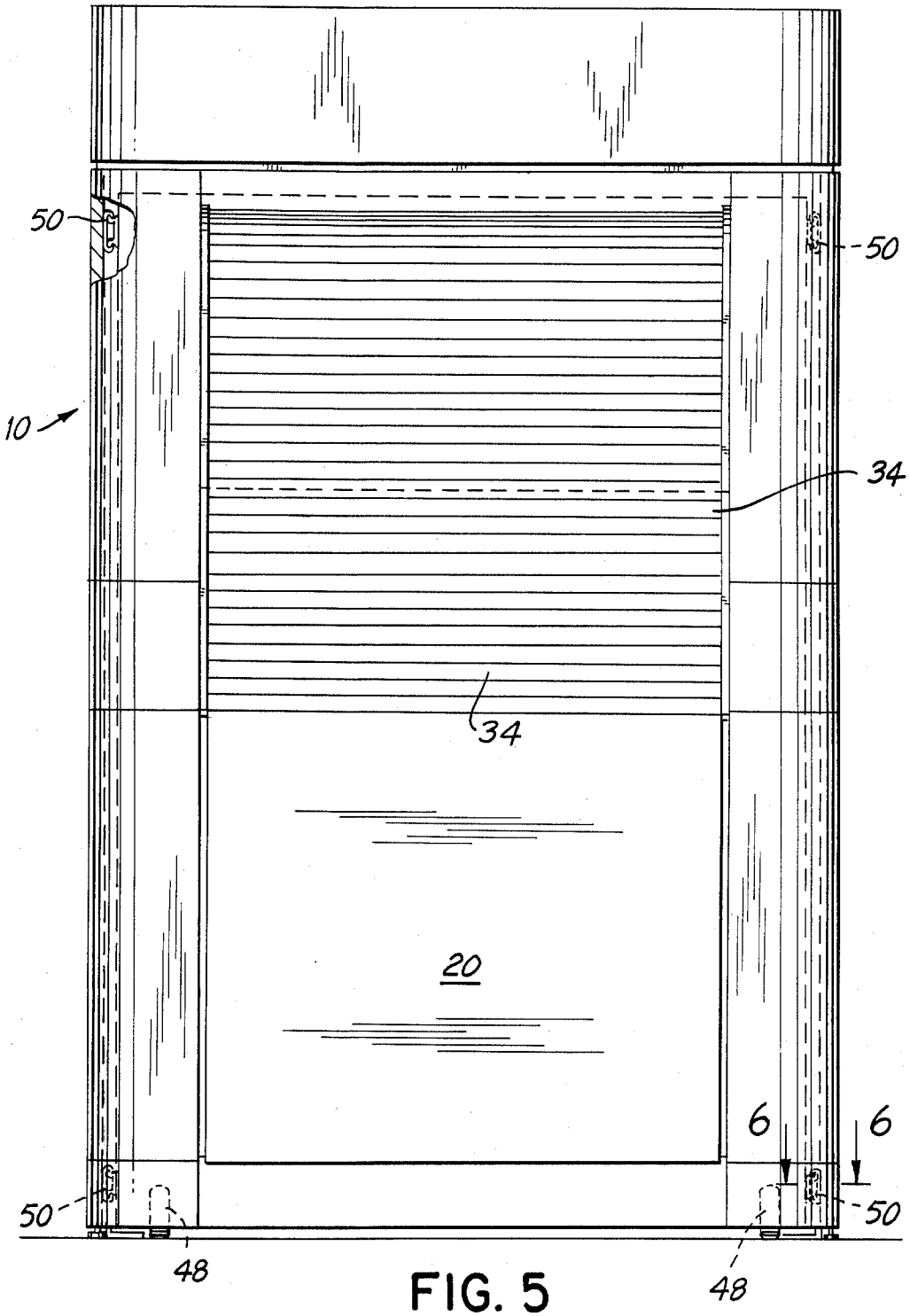
FIG. 5 is an elevational view of the front wall of the enclosure showing the tambour in its protracted position.

As best shown in FIG. 5, rollers 48 are connected to the base of front wall 20 to support and facilitate the movement of the front wall 20 between its inward and the outward positions. Slide guides 50 are also provided to aid in said movement of said front wall and to help hold it securely in its outward position. Slide guides 50 are conventional and act as stops to limit the motion of the front wall when it is moved from its inward to its outward position.

When front wall 20 is in its inward position, the operable front panel 14 of automatic teller machine 12 is accessible to a user through cut-out zone 22. However, when front wall 20 is in its inward position, openable rear service panel 16 is inaccessible and no repair work or cash replacement can take place. When access to rear panel 16 is desired, front wall 20 is unlocked and pulled forwardly from its inward position to its outward position.

After this front wall has been moved forward into its outward position, tambour 34 is pulled from its retracted to its protracted position to cover the cut-out zone 22 and secure the enclosure and the service personnel.

With front wall 20 in its outward position, door 46 is accessible and can be unlocked and opened so that service personnel enter into the second enclosure space 32. Base 36 can then be rotated to move the teller machine 180° so that the rear service panel 16 can be opened and servicing can occur.

What is claimed is:

1. A securely enclosed teller machine comprising:

a teller machine having an operable front panel and an openable service panel; and a secure enclosure around said teller machine, said enclosure including;

a first side wall extending at least from a floor at a first side of the teller machine, up, over and down to the floor on the second side of the teller machine;

a front wall, said front wall being formed with a cut-out zone therein, said front wall movable between an inward position in which it is secured to said first side wall and an outward position in which it is disconnected from said first side wall, said front wall in said outward position being spaced from said first side wall, said cut-out zone having a perimeter sized and shaped to contact said teller machine when said front wall is in said inward position to expose said front panel;

said first side wall and said front wall in said inward position, defining a first enclosure space;

a second side wall connected to said front wall, and extending in from said front wall;

said second side wall, when said front wall is in said outward position, extending between said first side wall and said front wall to provide a second enclosure space outward of and in communication with said first enclosure space, and a flexible shield movable between a retracted position and a protracted position, said shield when in said protracted position covering said cut-out zone and protecting said enclosure space when said front wall is in said outward position, said shield when in said retracted position uncovering said cut-out zone and permitting said cut-out zone to expose said operable front panel when said front wall is in said inward position.

2. The apparatus of claim 1 further comprising:

a rotatable platform capable of rotating said teller machine at least 90° such that when said front wall is in its inward position said operable first panel is accessible to a user and when said front panel is in its outward position said openable service panel is accessible to a servicer.

3. The apparatus of claim 1 further comprising:

a door in said second sidewall, said door being contained within said first side wall and being inaccessible when said front wall is in said inward position.

4. The apparatus of claim 2 further comprising:

a door in said second sidewall, said door being contained within said first side wall and being inaccessible when said front wall is in said inward position.

5. The apparatus of claim 2 further comprising:

a roller mechanism connected to the base of said front wall to support and facilitate movement of said front wall between said inward and said outward positions.

6. The enclosure of claim 1 wherein said flexible shield is a sliding tambour panel.

7. The enclosure of claim 2 and further comprising groove wheels and pipe track, said wheels positioned for movement along said track and said wheels supporting said base.

* * * * *